United States Patent [19]

Monick

[11] 4,365,971

[45] * Dec. 28, 1982

[54] PRESSURE DISPENSABLE GELLED ALCOHOL FUEL

[75] Inventor: John A. Monick, Teaneck, N.J.

[73] Assignee: Colgate-Palmolive Company, New York, N.Y.

[ * ] Notice: The portion of the term of this patent subsequent to Apr. 14, 1998, has been disclaimed.

[21] Appl. No.: 70,074

[22] Filed: Aug. 27, 1979

Related U.S. Application Data

[63] Continuation of Ser. No. 937,385, Aug. 28, 1978, abandoned, which is a continuation of Ser. No. 596,346, Jul. 16, 1975, abandoned.

[51] Int. Cl.[3] ..... C10L 7/04

[52] U.S. Cl. ..... 44/7 C; 252/305; 222/635

[58] Field of Search ..... 44/7 C, 7 D; 252/305; 222/635

[56] References Cited

U.S. PATENT DOCUMENTS

| | | | |
|---|---|---|---|
| 2,948,595 | 8/1960 | Orr | 252/305 |
| 3,134,720 | 5/1964 | Green et al. | 252/305 |
| 3,461,006 | 8/1969 | Fay et al. | 44/7 C |
| 3,719,752 | 3/1973 | Taylor | 252/305 |
| 3,801,292 | 4/1974 | Tanner et al. | 44/7 D |

FOREIGN PATENT DOCUMENTS

| | | | |
|---|---|---|---|
| 2257628 | 5/1973 | Fed. Rep. of Germany | 252/305 |
| 1251002 | 10/1971 | United Kingdom | 44/7 C |

OTHER PUBLICATIONS

Herzka, "International Encyclopedia of Pressurized Packaging (Aerosols)", pp. 484 & 487, Pergamon Press, (1966), Oxford.

Atlas Powder Co., "Atlas Cosmetic Bulletin", CD—15-2—5M, (7-1959) p. 1.

*Primary Examiner*—Edward A. Miller

*Attorney, Agent, or Firm*—Herbert S. Sylvester; Murray M. Grill; Richard N. Miller

[57] ABSTRACT

A pressurized fuel gel composition particularly suitable for igniting wood and charcoal consisting essentially of, by weight, 42–90% of at least one $C_1$–$C_6$ monohydric alcohol, 0.5–6% of a water-soluble gelling agent, up to about 24% water and a correlated amount of propellant from 0.5% to 30% characterized by a gel structure which forms a shape retaining mass upon contact with wood or charcoal that is maintained during the burning of said composition. Also within the scope of the invention is an aerosol product comprising said pressurized composition enclosed within a pressure-tight container having valve means for expelling the composition.

4 Claims, No Drawings

PRESSURE DISPENSABLE GELLED ALCOHOL FUEL

This is a continuation of Application Ser. No. 937,385, filed Aug. 28, 1978, now abandoned, which is in turn a continuation of Ser. No. 596,346, filed July 16, 1975 and now abandoned.

BACKGROUND OF THE INVENTION

1. Field of the Invention

This invention is directed to a pressurized fuel gel composition which is particularly suitable for igniting wood and charcoal.

The burning, or setting on fire, of a combustible material such as charcoal requires heating the material at or above its ignition point of kindling temperature until the combustion reaction starts and continues. This ordinarily is accomplished by placing the combustible material directly in contact with a flame until combustion starts. Usually, a fire starter product for igniting wood and charcoal is employed to produce the flame, which must be of sufficient duration of time to effect ignition. Since flame duration is dependent upon many factors, one being the wind which is difficult to control, effective fire starters are designed to provide a flame duration of at least about four minutes. If the flame duration is shorter, additional material and another ignition will normally be required.

In addition, to be effective as a fire starter it is important that the fuel gel be readily dispensed from the container and that it stay concentrated and set up in a mass on the material to be burned at the point where it is dispensed. For example, to ignite charcoal the charcoal generally is formed in a mound and the gel is dispensed into space in the mound which are called firepoints. These firepoints (normally four are sufficient) are burned and, upon burning for a certain length of time, the charcoal is ignited. The ability of the fuel gel to form a mass enables the fuel to form a concentrated burning point. However, it is important that the fuel gel remain in a shape retaining mass during the burning thereof and that it not melt or otherwise dissipate into a thin film of fuel which would burn much more rapidly and not ignite the charcoal unless relatively larger amounts were used.

2. Description of the Prior Art

It is well-known that a wide variety of products are currently sold for use as charcoal and wood fire starters. However, many of these products are subject to one or more significant disadvantages. For example, liquid type fuels tend to burn very rapidly and, therefore, many times do not provide fire ignition and require another application for ignition. This shortcoming of liquid fuels is due to their liquid form which does not normally adhere in sufficient amounts to the briquettes but instead flows off the sides thereof. Additionally, liquid fuels can be dangerous because of the problem of flame flashback wherein the dispensing stream of liquid becomes ignited causing the liquid in the dispensing container to ignite.

Another commercial fire starter product is an impregnated solid which requires a physical breaking and distribution thereof. Such steps are time consuming, and often result in the soiling of the hands or clothes of the user, thereby causing consumer dissatisfaction.

Gel hydrocarbon based fire starter products have also been used, but these are characterized by burning with an odor and producing a relatively large amount of soot. Additionally, these gel products tend to melt upon burning and do not maintain their dispensed shape but instead tend to flow over the charcoal briquettes forming a thin film of gelled material analogous to the liquid fuels. This characteristic shortens the product burning time and relatively large amounts of the gel must be used to effect ignition of the charcoal. These products are commercially available in a squeeze can and have been known for use in aerosol dispensers with nonflammable propellants. Further, the hydrocarbon base aerosol fuel gel products appear to require that the nonflammable propellant be allowed to vaporize before the gel can be ignited. Accordingly, these shortcomings of the hydrocarbon gel products have severely limited consumer acceptance.

Alcohol fuel gel products are known for commercial applications and such products burn with a clean, nonsooty flame. Such products are available in the form of individual cubes and in the form of a paste gel which is dispensed from a squeeze tube. However, while these alcohol gel products overcome many of the disadvantages of other known fire starters, such products still have deficiencies which appear to have limited consumer use and acceptance. For example, the product in cube form is expensive because it is more costly to manufacture in that form and requires additional time to dispense. The paste gel in the squeeze tube obviates the time consuming dispensing problem, but is subject to the flame flashback problem characteristic of the liquid fire starters discussed above. Thus, a need still exists for a fire starter product which is effective, clean burning and safe and convenient to use.

SUMMARY OF THE INVENTION

The present invention relates to an improved fire starter product which is a pressurized fuel gel composition. This pressurized fuel gel composition consists essentially of, by weight, about 42% to 90% of at least one $C_1$–$C_6$ monohydric alcohol, about 0.5 to 6% of a water-soluble gelling agent, up to about 24% water, and a propellant selected from the group consisting of about 5% to 30% of $C_3$–$C_5$ hydrocarbons or halogenated $C_1$–$C_4$ hydrocarbons and about 0.5% to 2% of nitrogen, carbon dioxide or air said propellant being effective to provide a pressure of from 12 p.s.i.g. to about 100 p.s.i.g. when said composition is packaged in a pressure tight container, and said composition being characterized by a gel structure which forms a shape retaining mass upon contact with wood or charcoal that is maintained during the burning of said composition.

Additionally, the present invention contemplates an aerosol product for producing a fuel gel particularly suitable for igniting wood and charcoal which comprises the pressurized alcohol fuel gel composition enclosed within a container equipped with valve means to form a pressure tight container for dispensing said pressurized composition whereby upon actuation of the valve means the fuel gel is dispensed therefrom in a gel form which upon contact with the surface of the combustible material sets up and forms a mass of the gel which maintains its shape during burning thereof.

One surprising feature of the inventive pressurized fuel gel composition is that it exhibits a form retaining gel structure. This structure obtains despite the fact that it contains a lower proportion of gelling agent than the prior art alcohol fuel products in order to lower the viscosity so that it may be expelled from the container and despite the fact that it contains propellant and propellant voids which serve to disrupt the gel structure. In fact, in the preferred embodiment wherein a hydrocarbon propellant is employed, it would be expected that the propallant would serve only to dilute the alcohol medium and weaken the gel structure. While no definite explanation for this phenomenon is known, it is theorized that when the pressurized fuel gel composition is expelled from the container the gelling agent coacts with the entrained propellant as well as with any air entrained in any propellant voids to form a more rigid gel structure.

Another unusual aspect of the inventive pressurized fuel gel composition is that the gel ignites easily despite the presence of the propellant and propellant voids. In this way it differs from the aerosol hydrocarbon fuel gels of the prior art.

A preferred embodiment of the inventive pressurized alcohol fuel gel composition employs, by weight, from 60% to 90% of alcohol, with a major proportion thereof being ethanol, 0.5% to 1.75% of an amine neutralized carboxy vinyl polymer gelling agent, water, and a $C_3$–$C_4$ hydrocarbon propellant. In the absence of the propellant, the alcohol fuel gel has a viscosity from about 5,000 cps. to about 40,000 cps. when measured at 25° C. using a Model RVF Brookfield Viscometer at 10 rpm with a No. 7 spindle, said fuel gel having a correspondingly higher viscosity of about 15,000 cps. to about 125,000 cps. when similarly measured at 2 rpm with a No. 7 spindle.

DETAILED DESCRIPTION OF THE INVENTION

The major component of the pressurized fuel gel composition is the monohydric alcohol ingredient which provides the flame upon ignition.

The monohydric alcohols which are employed in the practice of the present invention are those containing from 1 to 6 carbon atoms, such as methanol, ethanol, propanol, isopropanol, butanol, isobutanol, hexanol and the like. These alcohols can be employed alone or in mixture with each other. Although ethyl alcohol alone forms an excellent combustible gel, it burns with a substantially non-luminous flame. Accordingly, it is preferred that one of the other alcohols, that is, one of the $C_3$–$C_6$ alcohols, be utilized therewith when luminosity is desired. In such preferred mixtures, the $C_3$–$C_6$ alcohol used with ethyl alcohol is generally present in an amount of about 14% to 38% by weight, based on the total weight of the composition. Additionally, known compounds may be added to the gel composition to provide a visible flame, e.g., benzaldehyde and benzoic acid. Usually, commercial ethyl alcohol containing such relatively innocuous substances as brucine and brucine sulfates, which are complex alkaloids, or denaturants is preferred in preparing gel fuels in accordance with the present invention. However, ethyl alcohol containing other known denaturants can also be used. On the other hand, the $C_3$–$C_6$ alcohols when used alone normally provide both excellent properties of combustibility, as well as luminosity.

The alcohols are the major ingredient in the pressurized compositions. While the total amount of alcohol or mixtures thereof can vary widely, generally the total alcoholic content in the pressurized fuel gel composition will be in a range of about 42% to 90% by weight based on the total weight of the composition and compositions containing from about 60% to 90% by weight are especially preferred since they exhibit extremely good properties for a charcoal lighter, including burning with a high heat content per unit weight and for a correspondingly longer time.

The gelling agents employed in the pressurized alcohol fuel gel compositions are water-soluble or water-dispersible, provide an extrudable gel and are well-known to those skilled in the art. Among the suitable gelling agents are cellulose, chemically modified cellulose, carboxy vinyl polymers and olefin maleic anhydride copolymers. Representative chemically modified celluloses include methyl cellulose, ethyl cellulose, dihydroxy methyl ether derivatives of cellulose, hydroxymethyl cellulose, hydroxyethyl cellulose and hydroxypropyl cellulose. Suitable carboxy vinyl polymers include the non-cross-linked and cross-mono-olefinic polymers, copolymers and interpolymers wherein the monomeric component includes about 25% by weight of a monomeric olefinically unsaturated carboxylic acid. Other suitable gelling agents include the copolymers of a $C_2$–$C_4$ olefin with maleic anhydride, such as ethylene maleic anhydride polymers. These gelling agents are available through normal commercial channels and are well-known to those skilled in the art.

Highly preferred gelling agents are the carboxy vinyl polymers which are disclosed in British patent specification No. 799,951, published Aug. 13, 1958, and U.S. Pat. No. 2,798,053, granted July 2, 1957. The polymers disclosed therein are compositions comprising a cross-linked interpolymer of (a) a monoolefinic monomeric material comprising at least 25% by weight of a monomeric olefinically-unsaturated carboxylic acid containing at least one activated carbon to carbon double bond such as acrylic acid, and (b) from about 0.01% to 10.0% by weight of a polyunsaturated crosslinking agent containing a plurality of polymerizable vinyl or crotyl groups such as a polyalkenyl polyether of a polyhydric alcohol. More particularly the preferred interpolymers are derived from a mixture of acrylic acid and a polyether of sucrose in which the hydroxyl groups which are modified are etherified with at least two allyl groups per molecule. A specific example of such a material is Carbopol 934 which contains about 97.5% to 99.8% by weight of acrylic acid and about 0.2% to about 2.5% by weight of a monomeric polyether of sucrose in which the hydroxyls are etherified with at least two, and preferably about five to about six allyl groups per sucrose molecule. Such carboxylic polymers are available commercially in the free acid form and neutralized by the presence of an alkali metal base such as sodium or potassium hydroxide or a weak amine base contained in the composition and defined hereinbelow.

Generally any weak amine base can be used to neutralize the carboxyl vinyl polymers defined above. Although the weight percent amount of any particular amine compound employed should be enough to completely neutralize the acidic polymer and is preferably equal by weight to the weight of polymer present in the composition, greater or lesser amounts can usefully be present in the composition so long as the amount present is substantially completely utilized for neutralization of the acidic polymer. Among the preferred amines which are useful in preparing the new fuel gel composition of the invention are the mono-, di- and tri-aliphatic amines containing from 1 to about 8 carbon atoms in the aliphatic carbon chain and wherein the substituent group can be the same or different in the di- and tri-compounds. However, the amines containing one or more aliphatic groups containing 3 to 8 carbon atoms are especially preferred. Among such compounds are mono-, di and tri-methyl, ethyl, propyl, butyl, amyl, hexyl amines and the like. A particularly effective amine is di-2-ethylhexyl amine. It is to be noted that the terminology "weak amine base" is also intended to include alkylolamines containing from 1-8 carbon atoms in the alkyl group. Such compounds include the mono, di- and tri-methanolamines, ethanolamines, propanolamines, etc. and the like.

The proportion of gelling agent in the pressurized compositions will vary according to the particular agent employed and the other ingredients, in particular, water, and will usually range from about 0.5% to 6% by weight of pressurized composition. Preferably, the proportion of gelling agent will be from about 1% to 4% by weight of the pressurized composition. The proportion of gelling agent should be sufficient to provide a viscosity of about 5,000 centipoise (cps.) to about 40,000 cps. (measured on a Model RVF Brookfield Vascometer at 10 revolutions per minute (rpm) using a No. 7 spindle) in the alcohol fuel gel composition prior to the addition of propellant thereto. The proportion of gelling agent also is related to the viscosity of the particular agent in water alone. When the preferred carboxy vinyl polymer is employed, the proportion will be from about 0.5% to 1.75%, preferably from 0.85% to 1.28%, by weight of the pressurized composition. The proportions of other gelling agents such as methyl cellulose, hydroxy propyl cellulose and ethylene-maleic anhydride polymers usually will be slightly higher, such as, from about 1.5% to 4% by weight of the pressurized composition.

The fuel gel composition of this invention usually and preferably contain water to provide a desired gel structure. Usually up to about 24% by weight of water is employed based upon the weight of the pressurized composition. When employed, the amount of water employed must be sufficient to provide the desired gel structure. Thus, the proportion used depends upon the specific gelling agent employed. For example, when hydroxy propyl cellulose is the gelling agent, water is not necessary to form the gel but may be suitably employed in amounts up to 24% preferably 3% to 10%, by weight of the pressurized composition to reduce the amount of gelling agent required. The other cellulose gelling agents behave similarly On the other hand, when the preferred carboxy vinyl polymer is employed, water is required to form the desired gel structure and the proportion of water will be from about 3.5% to about 24%, preferably 3.5% to 11%, e.g., 8% by weight of the pressurized composition. Since the proportion of water often affects the burning rate, the proportion of water also must be integrated with the proportion of alcohol.

The propellants used in the inventive pressurized compositions include liquefied $C_3$-$C_5$ hydrocarbons, liquefied halogenated $C_1$-$C_4$ hydrocarbons, nitrogen, carbon dioxide and compressed air. Mixtures of propellants also may be employed. Suitable liquefied hydrocarbon propellants include propane, butane, isobutane and pentane. Suitable liquefied halogenated alkanes include dichloro-difluoromethane, trichloromonofluoromethane, tetrafluoro-dichloroethane, pentafluoromonochloroethane, triflurotrichloroethane, cyclic hexa-fluoro-dichlorobutane, octa-fluoropropane and cyclic octafluoro-butane, with the fluoro-chloro $C_1$-$C_2$ alkanes being preferred. The preferred propellants herein are the $C_3$-$C_4$ hydrocarbons.

The proportion of propellant should be selected to provide a pressure within the pressure tight container in the range of 12 p.s.i.g. to about 100 p.s.i.g., preferably from 15 to 50 p.s.i.g., and most preferably from 15 to 25 p.s.i.g. Less than about 10 p.s.i.g. is not sufficient to expel product from the container at a reasonable rate.

When the propellant is a liquefied $C_3$-$C_5$ hydrocarbon or liquefied halogenated $C_1$-$C_4$ hydrocarbon the amount employed will usually be from about 5% to 30%, preferably from 5% to 20%, e.g., 15%, by weight of the pressurized composition. Gaseous propellants, such as nitrogen, carbon dioxide and compressed air, are normally employed in amounts of at least about 0.5% to about 2% by weight of the pressurized composition, with amounts of about 0.75% to 1.25% being preferred. Again, the proportion of propellant in the pressurized composition will depend upon the specific propellant(s) selected.

The pressurized compositions are packaged in a container equipped with valve means, and optionally a dip tube, to form the aerosol product. The valve means are normally hand operated and the orifice size in the valve means will range from about 0.5 millimeters (mm.) to 6 mm., preferably from 2 mm. to 4 mm., to insure a reasonable rate of expulsion of product. When the valve means is closed, the container and valve means form a pressure tight "aerosol can". Such containers and valve means are standard articles of commerce and are well known to those skilled in the art.

When the valve means on the container is opened, the pressurized composition is readily dispensed from the container at a rate sufficient to form a firepoint in about 4 to 10 seconds. At container pressures in the range of about 12 to 25 p.s.i.g., the pressurized composition is dispensed in the form of a gel similar in appearance to that dispensed from a squeeze tube, but characterized by containing entrapped propellant. Where internal container pressures exceed about 25 p.s.i.g., the pressurized composition is in the form of a more frothy or aerated gel. However, in either case the gel structure is sufficient to cause the gel to set up on the predetermined surface in a concentrated mass, e.g., in the shape of a mound. Additionally, the fuel gel maintains its dispensed shape during the burning thereof so as to provide a firepoint having a maximum burning time duration.

The pressurized composition is formed upon addition of the propellant ingredient and such composition is in the form of a substantially homogeneous gel. The fuel compositions may be prepared by relatively simple formulation procedures. For example, the gelling agent is added to a mixing vessel 1 containing the alcohol, water and other ingredients while vigorously stirring until a homogeneous gel is formed.

The improved pressurized fuel gel compositions can also have optional ingredients incorporated therein. Such ingredients include small amounts of dyes, such as, Rose Bengal dye, for identification or aesthetic value. Usually the dyes are introduced in either aqueous or alcoholic solution. Other optional ingredients include perfumes, ash reducing agents such as sodium and potassium salts of nitrates and chlorates, compounds forming a visible flame such as benzaldehyde and benzoic acid and nonionic detergents such as the polyoxyethylene-polyoxypropylene condensates of propylene glycol sold under the trademark Pluronic®. These optional ingredients are present in small amounts which usually do not exceed 1.% by weight and preferably are less than 0.5% by weight.

The following examples are illustrative of the inventive compositions and products which, it is understood, are not limited to the examples. In the examples, all percentages are on a weight basis unless otherwise indicated.

EXAMPLE I

A particularly suitable aerosol product contains a pressurized composition having the following formula:

| | % by weight |
|---|---|
| Ethanol[1]-Anhydrous | 61.0 |
| Isopropanol-Anhydrous | 23.8 |
| Carboxy vinyl polymer[2] | 0.94 |
| Di (2-ethyl hexyl) amine | 0.94 |
| 1% solution of Rose Bengal dye in water | 0.094 |
| Water | 7.676 |
| Butane | 5.55 |
| | 100.000 |

[1]Specially denatured grade 3A (SD 3A)

This composition is prepared by slowly adding Carbopol 934 to the mixture of alcohols, water and dye solution in a mixing vessel with vigorous agitation until the polymer is well dispersed and dissolved. The amine is then added to the mixture over a five minute period with vigorous stirring. The mixing is carried out at room temperature (cs. 25° C.) and at atmospheric pressure. 8.5 Avoirdupois ounces (ozs.) of the resultant mixture is then charged into a 12 liquid ounce container, the container is crimped and is closed with a top spout aerosol dispensing nozzle having a 4 millimeter (mm.) diameter opening and is filled with 0.5 Avoirdupois ounces of butane propellant. The aerosol product does not have a dip tube and must be inverted during actuation. The pressure in the aerosol container is 20 p.s.i.g.

When the valve is actuated, the product is expressed in the form of a viscous liquid stream which contains bubbles of propellant. The pressurized fuel gel composition dispenses readily and sets up readily to form a mass of gel at the point of application.

The aerosol product is employed in igniting a charcoal fire by preparing 32 charcoal briquettes in a conical shaped mound and dispensing about one-third Avoirdupois ounce (about 9.5 gram) at each of four points in the mound. An identical composition dispensed from the conventional squeeze tube of the prior art is employed to provide a comparative standard and each firepoint contained approximately 14 grams (½ oz.) of the test composition. The pressurized composition is observed to dispense readily from the aerosol container and to set up and form a mass of gel at the point of application. The four points are immediately ignited after dispensing and the gel burning time and the cooking time i.e., the time at which about 95% of the charcoal is about 75% gray and 25% black, are measured. (The cooking time is the time at which the fire is considered to be ready for cooking.) The dispensed gel essentially maintains its mass shape during the entire burning period and the results are shown in Table A below.

TABLE A

| Product | Burning Time (minutes) | Cooking Time (minutes) |
|---|---|---|
| Example I | 6 | 17 |
| Standard | 7 | 18 |

The foregoing results show that the presence of propellant in the pressurized composition does not cause the gel to breakdown and liquefy during burning. Further, the presence of propellant has a beneficial effect on the burning time since a lower amount (38 grams versus 56 grams of the standard) provides essentially the same burning time and cooking time.

Substantially equivalent results are obtained when butanol, pentanol or ethanol is substituted for isopropanol in the pressurized composition of Example I. However, when ethanol is employed, the flame is substantially non-luminous; whereas, in the presence of the $C_3$–$C_5$ alkanols a luminous flame is obtained.

EXAMPLE II

The following pressurized composition is prepared in accordance with the procedure set forth in Example I:

| | % by weight |
|---|---|
| Ethanol[1]-Anhydrous | 55.10 |
| Isopropanol-Anhydrous | 21.30 |
| Carboxy vinyl polymer[2] | 0.85 |
| Di (2-ethyl hexyl) amine | 0.85 |
| 1% solution of Rose Bengal dye in water | 0.085 |
| Water | 6.815 |
| Butane | 15.000 |
| | 100.000 |

When 10 Avoirdupois ounces of the resultant pressurized composition is charged into the valved container of Example I, the pressure in the container is 28 p.s.i.g. Again, the product is expressed in the form of a viscous liquid stream, but compared with Example I, is a somewhat more frothy gel, i.e., the gel contains larger bubbles and is not as evenly dispensed.

To evaluate the charcoal ignition characteristics of the pressurized composition, comparative samples of the pressurized compositions of Example I and Example II are tested by dispensing approximately one-half Avoirdupois ounce (14 grams) of the composition onto a sheet of aluminum foil by holding the spout of the dispensing valve about three inches above the center of the foil. A simulated firepoint results which is ignited and the burning time measured. Based on the results of Example 1, the pressurized composition of Example 2 (using 4 firepoints of one-third ounce each) would produce a flame for 4 minutes and 10 sec.

EXAMPLES III–IV

The aerosol product of Example II is repeated with the exception that the butane propellant is replaced by a like proportion of a mixture of 80 mole percent of isobutane and 20 mole percent of propane (Example III) and isobutane (Example IV). The aerosol product of Example III exhibits a pressure of 50 p.s.i.g. and is expelled from the container as a frothy gel which sets up on contact with a surface. The aerosol product of Example IV exhibits an internal pressure of 44 p.s.i.g. and likewise is expressed in the form of forthy gel. It appears that a portion of the froth in the gel collapses as part of the propellant apparently escapes while another portion of the froth remains more stable.

When the procedure as set forth in Example II to evaluate the charcoal ignition characteristics is performed, the comparative results of the pressurized compositions of Example III and Example IV would produce a flame for 6 minutes and 4 minutes and 37 seconds, respectively.

EXAMPLE V

Another suitable aerosol product is prepared according to the process of Example II and contains a pressurized composition having the following formula:

| | % by weight |
|---|---|
| Ethanol[1]-Anhydrous | 54.24 |
| Isopropanol-Anhydrous | 21.30 |
| Carboxy vinyl polymer[2] | 1.28 |
| Di- (2-ethyl hexyl) amine | 1.28 |
| 1% solution of Rose Bengal dye in water | 0.085 |
| Water | 6.815 |
| Butane | 15.000 |
| | 100.000 |

When 10 ozs. (ounces) of the pressurized composition is packaged in a container with a 0.5 mm. orifice dispensing spout at the center of the top of the container, actuation of the valve means results in delivery of a gel stream at a rate of 2.7 gram/second. Actuation of the valve means for about 7 seconds provides a material that burns for about 6¼ minutes. On the other hand, when a container having a dispensing spout with an orifice diameter of 0.5 mm. located at one side of the top of the container and containing a dip tube is employed, the internal pressure is reduced from 20 p.s.i.g. to 18 p.s.i.g. and a gel stream at a rate of 2.1 grams per second is provided. Actuation of the valve means for about 7 seconds provides a gel that burns for about 5 minutes. When employed to ignite a charcoal fire using a procedure as set forth in Example I, it is estimated that about 2 oz. of the pressurized fuel composition would be satisfactory.

Again, equivalent results are achieved when propane or a halogenated hydrocarbon, e.g., dichlorodifluoromethane, dichlorotetrafluoroethane, etc. is substituted for butane in Example V in a proportion selected to provide a pressure of about 20 p.s.i.g. Similarly, substitution of hydroxy propyl cellulose in an amount of about 2% is substituted for the carboxy vinyl polymer, water omitted, and additional ethanol added to make up the difference in the pressurized composition in Example V.

EXAMPLE VI

Another aerosol firestarter product is prepared according to the procedure described in Example I contains a pressurized composition of the following formula:

| | % by weight |
|---|---|
| Ethanol-Anhydrous[1] | 60.46 |
| Isopropanol-Anhydrous | 23.6 |
| Carboxy vinyl polymer[2] | 1.42 |
| Di (2-ethyl hexyl) amine | 1.42 |
| 1% solution of Rose Bengal dye in water | 0.094 |

-continued

| | % by weight |
|---|---|
| Water | 7.456 |
| Butane | 5.55 |
| | 100.000 |

The aerosol pressure is 18 p.s.i.g. When the procedure as set forth in Example II to evaluate the charcoal ignition characteristics is performed, the pressurized composition would produce a flame for 4 minutes and 37 seconds.

EXAMPLE VII

An aerosol firestarter product is prepared according to the procedure described in Example I, except that 4 ozs. of a pressurized composition of the following formula is charged into an 8 liquid ounce container:

| | % by weight |
|---|---|
| Ethanol[1]-Anhydrous | 64.25 |
| Isopropanol-Anhydrous | 24.76 |
| Carboxy vinyl polymer[2] | 1.00 |
| Di (2-ethyl hexyl) amine | 1.00 |
| 1% solution of Rose Bengal dye in water | 0.10 |
| Water | 7.99 |
| Nitrogen | 0.90 |
| | 100.000 |

The aerosol product exhibits an internal pressure of 90 p.s.i.g. and is expressed in the form of a gel stream which is similar in appearance to a non-pressurized gel except that it contains many small bubbles of propellant. When the pressurized composition is evaluated for igniting a charcoal fire as set forth in Example II, comparative results indicate it would produce a flame for 4 minutes and 8 seconds.

The aerosol product is tested by fourteen members of a panel for lighting charcoal. In the test, about 30 charcoal briquettes are arranged in a mound and the pressurized composition is applied to several areas around the bottom of the pile of briquettes and the fuel gel is ignited. After 10–20 minutes the briquettes are gray-colored which indicates they are suitable for cooking.

Substantially equivalent results are achieved when carbon dioxide is substituted for nitrogen in the pressurized composition of Example VII.

While the invention has been described with reference to certain embodiments thereof, it will be obvious to those skilled in the art that other modifications and variations of the invention can be made and various equivalents substituted therein without departing from the spirit and scope of the invention.

I claim:

1. A shape-retaining mass of a fuel gel composition in a pressure-tight container equipped with valve means and comprising by weight about 60% to 90% of alcohol, with a major proportion being ethanol and the remainder being a $C_3$–$C_4$ alcohol; about 0.5 to 1.75% by weight of a hydrophilic, cross linked carboxy vinyl polymer neutralized with a weak amine base as the gelling agent; about 3.5% to 11% of water, and about 5% to 30% of a $C_3$–$C_5$ hydrocarbon propellant (a) or about 0.5 to 2% of a propellant (b) selected from the group consisting of nitrogen, carbon dioxide and air, or mixtures of (a) and (b), said propellant being effective to provide a pressure of 12 p.s.i.g. to about 100 p.s.i.g. in said container, said composition having a viscosity whereby it is dispensed from said container in gel form upon actuation of the valve means and upon contact with the surface of wood or charcoal sets up and forms a mass of gel including entrained propellant.

2. A composition according to claim 1 containing about 0.85% to 1.28% by weight of said polymer.

3. A composition according to claim 1 containing as propellant a $C_{3-5}$ hydrocarbon in a proportion sufficient to provide a pressure of 12 to 25 p.s.i.g. in said container.

4. A composition according to claim 1 containing about 5% to 15% by weight of butane as propellant.

* * * * *